United States Patent [19]

Shinn

[11] 4,315,375

[45] Feb. 16, 1982

[54] EARTH MOVING BUCKET

[76] Inventor: Raymond R. Shinn, P.O. Box 534, Jordan Valley, Oreg. 97910

[21] Appl. No.: 170,884

[22] Filed: Jul. 21, 1980

Related U.S. Application Data

[63] Continuation-in-part of Ser. No. 51,534, Jun. 25, 1979, abandoned.

[51] Int. Cl.[3] ..... E02F 3/00

[52] U.S. Cl. ..... 37/118 R; 37/141 R; 172/719

[58] Field of Search ..... 37/103, 115–118 R, 37/118 A, 141 R, 141 T; 172/719

[56] References Cited

U.S. PATENT DOCUMENTS

| | | | |
|---|---|---|---|
| 203,042 | 4/1878 | Hill | 37/118 A |
| 2,861,908 | 11/1958 | Mickelson et al. | 37/142 R |
| 3,970,445 | 7/1976 | Gale et al. | 37/142 R |
| 4,129,952 | 12/1978 | Olson | 37/118 R |

FOREIGN PATENT DOCUMENTS

| | | | |
|---|---|---|---|
| 453230 | 6/1968 | Switzerland | 37/118 R |

OTHER PUBLICATIONS

"Stringer Beads Increase Bucket Life", Excavating Engineer, Apr. 1945, p. 197.

"Proven Hard Facing Methods", Construction Methods, Oct. 1962, p. 106.

*Primary Examiner*—E. H. Eickholt

*Attorney, Agent, or Firm*—Paul F. Horton

[57] ABSTRACT

An improved earth moving bucket which includes a plurality of hemispherical, wear-resistant members bonded directly to the undersurface of the bottom wall of the bucket. The outer, earth-contacting, sidewalls of the bucket may also be provided with hemispherical members. The hemispherical members have a hardness at least as great but no more than 95 units of hardness on the Brinell scale greater than the walls to which they are attached. The hemispherical members are preferably placed on the walls in a staggered row arrangement wherein adjacent hemispherical members are at no greater distance from one another than the diameter of the largest of adjacent members.

3 Claims, 3 Drawing Figures

EARTH MOVING BUCKET

COPENDING APPLICATION

This application is a continuation-in-part of my copending application, serial No. 06/051,534, filed June 25, 1979 and now abandoned.

BACKGROUND OF THE INVENTION

1. Field of the Invention

This invention relates, in general, to buckets used on mining and other earthmoving equipment and, more particularly, to buckets having wear-resistant members.

2. Description of the Prior Art

The need for wear-resistant buckets has long been recognized in the earth-moving field. In the art of mining, in particular, the high strength steel plates on the bottom of front shovels wear away in as little as four to five weeks because of the extremely abrasive nature of the materials being worked upon. The "down" time of extremely expensive equipment greatly affects the efficiency of the operation and results in higher prices to the consumer. Additionally, maintenance costs of such equipment is exorbitant.

Many varying approaches have been taken in attempting to solve the problem. Conventional methods include the placement of wear strips of increased thickness and of hard facing on the bottom surface of the buckets, however the weight of the strips places great stress on other operating parts of the equipment and provides, at the most, very little advantage in wear time. More recently, the emphasis has shifted, as typified by U.S. Pat. No. 4,129,952 issued to H. S. Olson, to the inclusion of extremely hard alloy inserts into sockets drilled or formed directly into the earth-contacting surface of the bucket or into wear strips bonded to the bucket. Tungsten carbide, an extremely hard and very wear-resistant material, has been used in some of the more recently designed mining equipment. While being logical in approach, such efforts have largely been unrewarding in that the baseplate or strip, into which the tungsten carbide or other extremely hard material is inserted, continues to wear away rapidly, thereby defeating the purpose and providing only temporary relief of the problem.

SUMMARY OF THE INVENTION

The present invention comprises an earth-moving bucket which includes a plurality of substantially hemispherical wear-resistant members bonded to a selected earth contacting surface thereof; the resistant members being of a hardness at least equal to but no more than 95 units of Brinell hardness greater than the base surface to which they are attached. A more thorough description may be found in the appended claims.

It has been found, quite unexpectedly, that hemispherical wear-resistant members having a hardness not much greater than the hardness of the base plate when bonded to the plate in close apposition increases the wear time by as much as tenfold. It is now believed that the inserts of extreme hardness, as for example tungsten carbide, tend to polish and therefore readily deflect that abrasive rock materials to the underlying plate. It is further believed that the polished surface provides a poor adhesive contact surface for wet materials which act as a "lubricant" between the abrasive materials and the baseplate. The controlled hardness of the wear-resistant members of the present invention allow the members to absorb the wear, thereby preventing substantial deflection of the abrasive material to the baseplate, and the hemispherical shape of the wear members of the present invention provide both maximum wear area and maximum adhesive contact area per weight and volume of member.

It is therefore an object of the present invention to provide an earth moving bucket having hemispherical wear-resistant members of comparable hardness to the baseplate upon which they are bonded.

It is a further object of the present invention to provide an earth moving bucket having wear-resistant hemispherical members bonded in a staggered relationship one to the other.

More specifically, it is an object of the present invention to provide an earth moving bucket having a plurality of hemispherical wear-resistant members bonded directly to the undersurface of the bottom wall of the bucket in staggered rows and wherein each hemispherical member is spaced from an adjacent member at no greater distance than the diameter of the hemispherical members.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
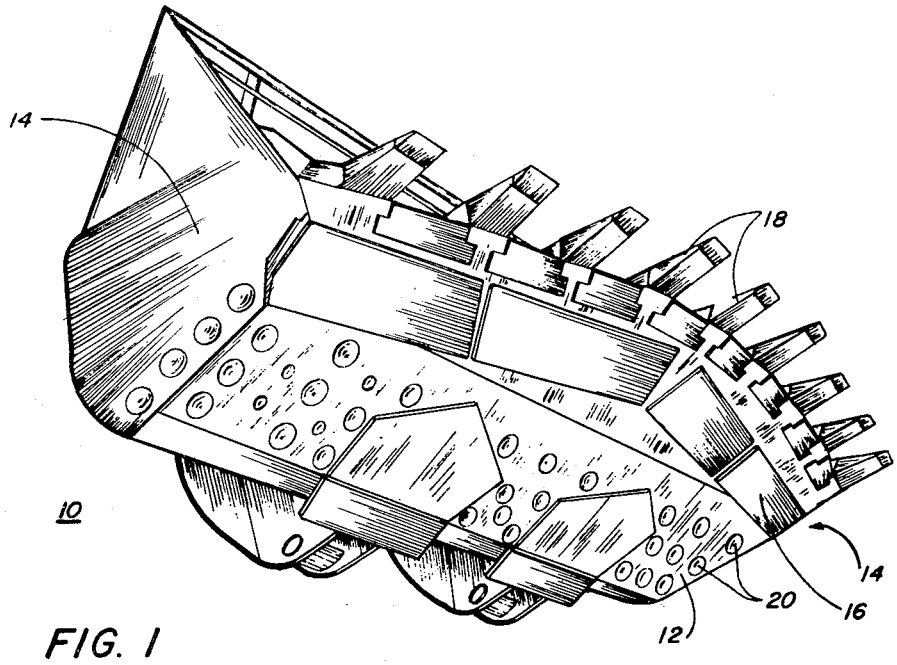
FIG. 1 is a perspective view of one embodiment of the present invention.
Figure 2:
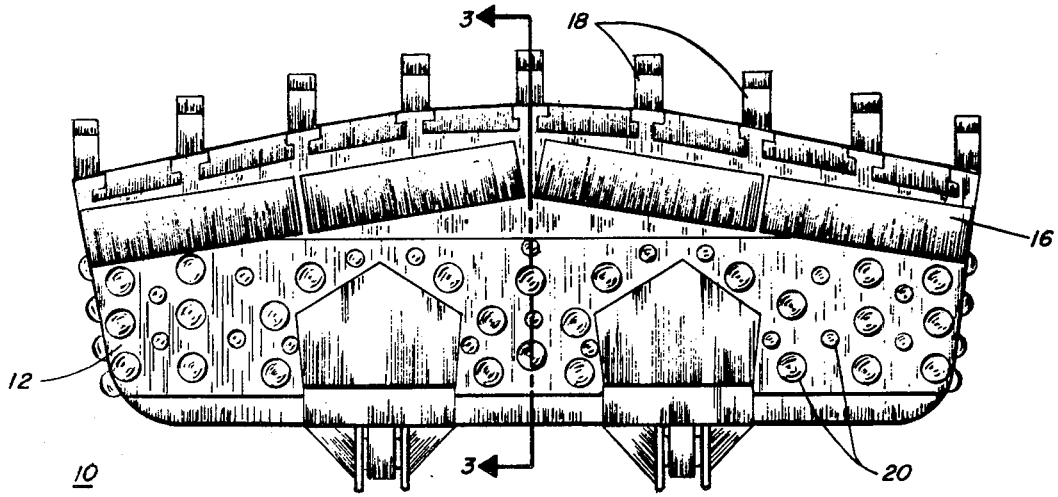
FIG. 2 is a plan view of another embodiment of the present invention.
Figure 3:
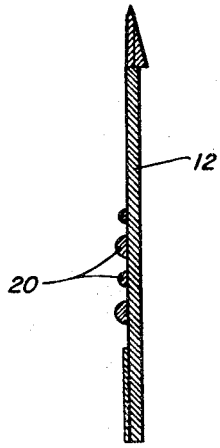
FIG. 3 is a sectional view along lines 3—3 of FIG. 2.

Referring now to the drawings, several preferred embodiments of an earth moving bucket 10 made according to the present invention is disclosed. Bucket 10 includes a bottom baseplate 12, a pair of side plates 14, and a back plate, not shown.

Bottom plate 12 may be provided with a conventional wear plate 16 and further includes a plurality of forwardly projecting teeth 18. The buckets shown in the drawings are merely representative of the many and various types of buckets used in the earth moving and mining industries. In the preferred embodiment, bottom baseplate 12 and side plates 14 are constructed of steel or other iron alloys of approximately 315 to hardness on the Brinell hardness scale, a scale commonly used in the trade for determining and designating indentation resistance.

As is shown in the figures, and according to the invention disclosed, a plurality of hemispherical wear-resistant members 20 are attached to the earth contacting, undersurface of bottom plate 12. Similarly, the hemispherical members may be attached to the outer earth contacting surfaces of side plates 14. It is a critical part of the invention that the hemispherical members be of a hardness of not less than the baseplates 12 and 14 to which they are attached and it is also a critical part of this invention that the hardness of members 20 not exceed by 95 units of hardness on the Brinell scale the baseplates to which they are bonded. It is also an important element of the present invention that the wear-resistant members 20 have a rounded contact surface for the purposes aforementioned and that they have a substantially planar base portion for attachment to the bottom wall or side walls. In this regard it is contemplated that the terms "hemispherical" and "substantially hemispherical" as used herein and in the appended claims include sections of a sphere that may be half or less than one-half the sphere.

It has been found that mill balls having a hardness rating of approximately 370–410 on the Brinell hardness scale are readily adaptable for use as the wear-resistant members of the present invention. The mill balls are cut in half with an acetylene and oxygen cutting torch and the resulting hemispheres are then welded to the exterior surface of conventional buckets in staggered positions. The hemispheres, preferably one to five inches in diameter, are welded with their planar base portion contacting the bottom walls or sidewalls of the bucket by first of all tacking the members approximately $\frac{3}{4}$ inch in length on four opposing sides before welding. This procedure eliminates cracks in the weld. The hemispheres are welded to the plates with wire approximately 70,000 to 80,000 PSI. The hemispheres should be welded with nothing less than 70,000 PSI wire, because they are likely to crack through the center during welding.

Hemispheric members 20 are preferably bonded directly to the selected wall in staggered rows and are spaced from one another at a distance no greater than the diameter of adjacent members. This, for the reason that members placed apart at too great a distance fail to adhere sufficiently to wettened abrasive material and therefore the lubricating action of the abrasive material, as it rolls upon itself, is significantly lessened. Additionally, too great of spacing permits direct contact between rocks or other abrasive material and the baseplate, resulting in an unacceptable amount of wear on the baseplate. Staggering of individual hemispherical members or staggering of rows of members prevents ruts forming in the wettened abrasive material, adhering to the baseplate and the hemispherical members, which would lessen the lubricating capacity.

Size of hemispheres used should be selected based upon several factors such as bucket size, anticipated working conditions, weight of the equipment, etc. While it is preferred that a common size, as for example a five inch hemisphere, be used on a particular piece of equipment, it is contemplated that, in certain instances, hemispheres of varying diameters might be used on the same bucket and, particularly, on the same earth contacting plate. When this is the case, the hemispherical members should be spaced from adjacent hemispheric members at no greater distance than the diameter of the largest of adjacent hemispherical members.

Having thus described in detail a preferred selection of embodiments of the present invention, it is to be appreciated and will be apparent to those skilled in the art that many physical changes could be made in the apparatus without altering the inventive concepts and principals embodied therein. The present embodiments are therefore to be considered in all respects as illustrative and not restrictive, the scope of the invention being indicated by the appended claims rather than by the aforegoing description, and all changes which come within the meaning and range of equivalency of the claims are therefore to be embraced therein.

I claim:

1. An earth moving bucket having a bottom wall, opposing sidewalls and a back wall wherein at least one wall includes a plurality of substantially hemispherical wear resistant members bonded to the outer earth-contacting surface of the wall in staggered relationship one to the other and wherein the wall to which the hemispherical members are bonded is of substantially 315–330 units hardness on the Brinell scale and wherein said hemispherical members are from substantially 370 to 410 units of Brinell hardness on the same scale.

2. The apparatus as described in claim 1 wherein said hemispherical members are bonded to the wall in staggered rows and wherein each hemispherical member is spaced from an adjacent hemispherical member at no greater distance than the diameter of the largest of adjacent hemispherical members.

3. The apparatus as described in claim 1 wherein each of the sidewalls and the bottom wall each include a plurality of said hemispherical wear-resistant members.

* * * * *